US005375772A

United States Patent [19]

Cristiani et al.

[11] Patent Number: 5,375,772

[45] Date of Patent: Dec. 27, 1994

[54] PERFECTED ELECTROMAGNETIC FUEL METERING AND ATOMIZING VALVE

[75] Inventors: Marcello Cristiani, Imola; Mirco Vignoli, Bologna, both of Italy

[73] Assignee: Weber S.r.l., Torino, Italy

[21] Appl. No.: 102,639

[22] Filed: Aug. 5, 1993

[30] Foreign Application Priority Data

Aug. 7, 1992 [IT] Italy ..... TO92 U 000207

[51] Int. Cl.[5] ..... F02M 51/00

[52] U.S. Cl. ..... 239/585.4; 239/585.1; 251/129.15; 251/129.21

[58] Field of Search ..... 239/585.1, 585.3, 585.4; 251/129.15, 129.21

[56] References Cited

U.S. PATENT DOCUMENTS

| | | | |
|---|---|---|---|
| 3,731,881 | 5/1973 | Dixon et al. | 239/585.3 |
| 4,339,082 | 7/1982 | Radaelli et al. | 239/585.4 |
| 4,951,878 | 8/1990 | Casey et al. | 239/585.4 |
| 5,080,288 | 1/1992 | Shen | 239/585.3 |
| 5,100,102 | 3/1992 | Schechter | 239/585.4 |
| 5,263,649 | 11/1993 | Babitzka et al. | 239/585.4 |

FOREIGN PATENT DOCUMENTS

| | | |
|---|---|---|
| 0026060 | 4/1981 | European Pat. Off. . |
| 0312708 | 4/1989 | European Pat. Off. . |
| 2330423 | 1/1974 | Germany . |
| 3811003A1 | 10/1989 | Germany . |

*Primary Examiner*—Karen B. Merritt

*Attorney, Agent, or Firm*—Baker & Daniels

[57] ABSTRACT

A valve comprising a plunger controlled by an electromagnet and in turn controlling fuel flow through an injection orifice; the plunger being defined by a cylindrical lateral surface mating in sliding manner with a corresponding cylindrical guide surface of a seat formed in the valve body. According to the present invention, the barycenter of the plunger lies in a plane of the valve perpendicular to the valve axis, and the distance between which plane and the mid plane of the cylindrical guide surface is less than 2 mm.

2 Claims, 1 Drawing Sheet

PERFECTED ELECTROMAGNETIC FUEL METERING AND ATOMIZING VALVE

BACKGROUND OF THE INVENTION

The present invention relates to a perfected electromagnetic fuel metering and atomizing valve for a vehicle fuel supply system.

Valves of the aforementioned type substantially comprise a plunger for controlling fuel passage through an injection orifice, and which, by means of an electromagnet, is moved inside an axial seat in the valve body, between a closed position wherein the injection orifice is closed, and an open position wherein fuel is allowed to flow through the orifice. The plunger is defined by a cylindrical lateral surface mating in sliding manner with a corresponding cylindrical surface of the seat in the valve body.

Valves of the aforementioned type present several drawbacks.

Firstly, fuel leakage frequently occurs between the bottom surface of the plunger and the corresponding supporting surface in which the injection orifice is formed. Secondly, the mating surfaces of the plunger and/or seat are subject to severe in-service wear, particularly localized wear on the edges of the mating surfaces. Thirdly, the manufacture of certain members and components of the valve, particularly the plunger and the portion of the valve body in which the plunger slides, involves accurate machining to precise tolerances. Finally, manufacture of the above components requires the use of high-cost materials, processing for hardening the sliding surfaces, or post-machining processing for depositing layers of hard material for reducing wear of the sliding components.

All the above drawbacks are caused by failure to provide for accurately guiding axial displacement of the plunger between the open and closed positions, and so maintaining the axis of the plunger perfectly parallel to that of the sliding seat and, consequently, of the valve. In fact, during operation of the valve, the plunger is subjected to two non-coplanar forces perpendicular to the valve axis. One of these is due to the transverse component of the inertial forces produced by vibration of the engine and by other in-service movements of the vehicle, which component may be imagined as being applied at the barycenter of the plunger and, consequently, as lying substantially in a plane perpendicular to the valve axis and containing the barycenter of the plunger.

The other force is the transverse component of the electromagnetic forces to which the plunger is subjected in the magnetic circuit of which it forms part, which component may be said, to a fairly good degree of accuracy, to act in a plane perpendicular to the valve axis and located at the mid plane of the cylindrical seat in which the plunger slides. By virtue of the above two components operating in non-coincident planes, the plunger is subjected to a torque which tends to rotate it about axes perpendicular to the valve axis, so that the axis of the plunger fails to be maintained parallel to that of the sliding seat, due to the radial clearance normally allowed between the plunger and seat for enabling the former to slide in relation to the latter. The above drawbacks are nevertheless also encountered even in the presence of very little radial clearance.

SUMMARY OF THE INVENTION

It is an object of the present invention to provide an electromagnetic fuel metering and atomizing valve of the type briefly described above, designed to overcome the aforementioned drawbacks.

According to the present invention, there is provided an electromagnetic fuel metering and atomizing valve for a fuel supply device, substantially comprising a plunger for controlling fuel passage through an injection orifice; said plunger being movable, inside a seat in the valve body and by means of an electromagnet, between a closed position wherein it closes said injection orifice, and an open position wherein fuel is allowed to flow through said orifice; said plunger being defined by a cylindrical lateral surface mating in sliding manner with a corresponding cylindrical guide surface of said seat; characterized by the fact that the barycenter of said plunger lies in a plane of the valve perpendicular to the valve axis, and the distance between said plane and the mid plane of said cylindrical guide surface of said seat is less than 2 mm.

The barycenter of the plunger preferably lies in a plane of the valve perpendicular to the valve axis, and which coincides with the mid plane of said cylindrical guide surface of said seat.

BRIEF DESCRIPTION OF THE DRAWINGS

A detailed description of the improved valve according to the present invention will be given with reference to the accompanying drawings, in which.

DETAILED DESCRIPTION OF THE INVENTION

Figure 1:
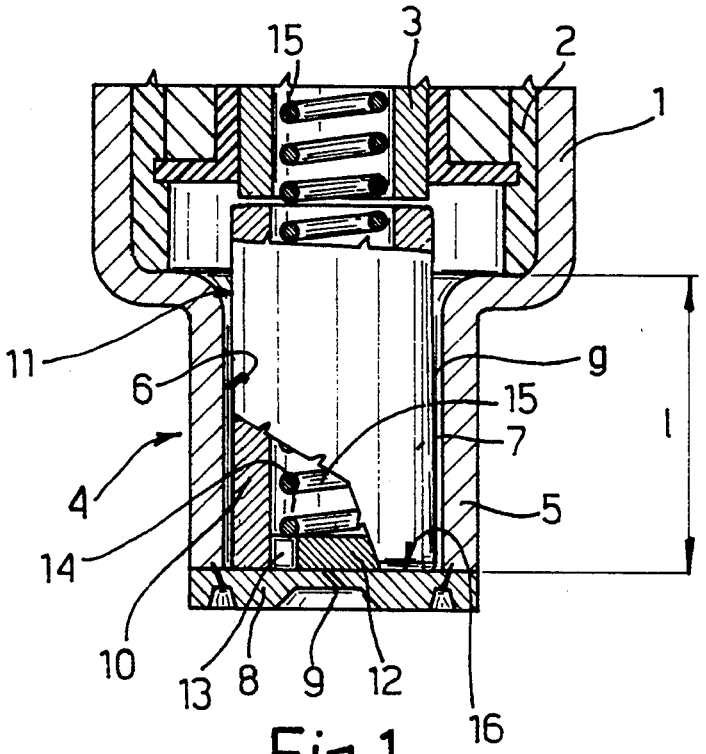
FIG. 1 shows a bottom axial section, in the closed position, of a fuel metering and atomizing valve in accordance with the teachings of the present invention.

The valve according to the present invention may be any known type of electromagnetic fuel metering and atomizing valve forming part of a vehicle fuel supply device and substantially comprising a body 1 housing an electromagnet 2 in turn housing a core 3 energized by the electromagnet. The bottom portion 4 of body 1 substantially comprises a cylindrical wall 5 inside which is formed a cylindrical surface 6 constituting the guide seat of a plunger 7. Body 1 is closed at the bottom by a disk 8 in which a fuel injection orifice 9 is formed.

Plunger 7 is substantially cylindrical, and comprises a lateral wall 10 defined externally by a cylindrical surface 11; and a substantially flat bottom wall 12 designed to rest on disk 8 for closing injection orifice 9. Wall 12 normally presents at least one hole 13 enabling passage of the fuel entering cavity 14 of plunger 7 via appropriate conduits on the valve.

The outside diameter of cylindrical surface 11 defining plunger 7 is slightly smaller than the inside diameter of cylindrical surface 6 of wall 5, so as to give a predetermined radial clearance g between surfaces 11 and 6; and plunger 7 is normally maintained in the closed position by a coil spring 15 housed inside cavity 14.

Figure 2:
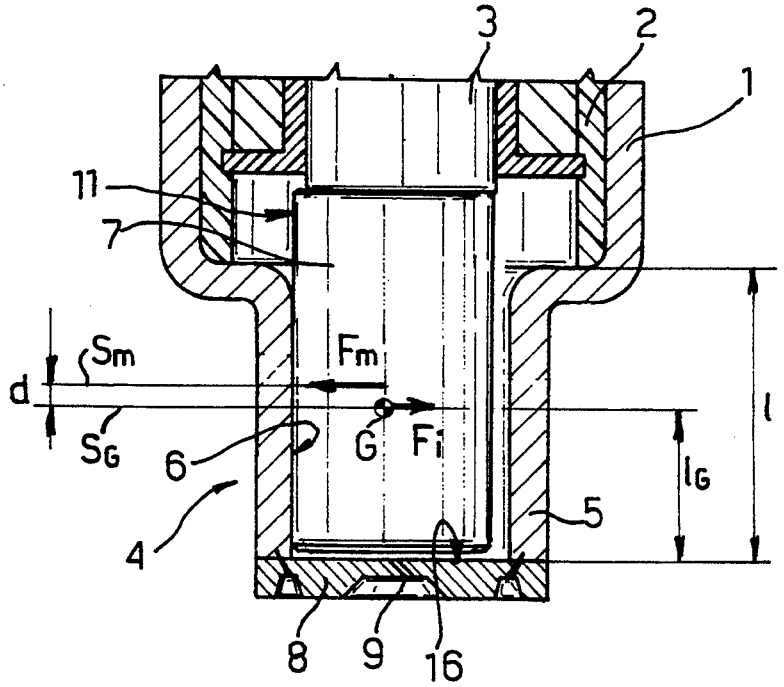
FIG. 2 shows the same section as in FIG. 1, but with the valve in the open position.

As shown in FIG. 2, the barycenter G of plunger 7 lies in a plane $S_G$ of the valve perpendicular to the valve axis; $S_m$ indicates the mid plane of cylindrical guide surface 6 of length l (FIG. 1); and d the distance between planes $S_G$ and $S_m$.

According to the present invention, distance d between planes $S_G$ and $S_m$ is less than 2 mm and preferably equal to 0, so that the two planes coincide.

In the event the characteristics of plunger 7 are defined, planes $S_m$ and $S_G$ may be made to coincide, or at least to be separated by a distance d of no more than 2 mm, by appropriately selecting the length l of cylindrical guide surface 6. Thus, if $l_G$ is the distance between barycenter G and upper surface 16 of disk 8 in which injection orifice 9 is formed, length l must meet the following condition:

$$(l_G-2\text{ mm})<\tfrac{1}{2}l<(l_G+2\text{ mm})$$

Conversely, in the event length l of cylindrical guide surface 6 is defined, the characteristics of plunger 7 are so selected that distance $l_G$ between barycenter G and upper surface 16 of disk 8 conforms with the following equation:

$$(\tfrac{1}{2}l-2\text{ mm})<l_G<(\tfrac{1}{2}l+2\text{ mm})$$

Component Fi of the inertial forces to which plunger 7 is subjected, and which are produced by vibration of the engine and by other in-service movements of the vehicle, substantially lies in plane $S_G$, perpendicular to the valve axis. Component Fm, on the other hand, of the magnetic forces to which plunger 7 is subjected, and which are due to the magnetic flux in the magnetic circuit of which plunger 7 forms part, lies in plane $S_m$, perpendicular to the valve axis. It has been found, to a fairly good degree of accuracy, that the resultant of said magnetic forces is in fact applied in the mid plane $S_m$ of cylindrical guide surface 6.

When the condition mentioned previously is met, and more specifically, when planes $S_G$ and $S_m$ coincide, components Fi and Fm lie in the same plane and so give rise to no torque. When displaced, therefore, plunger 7 is subjected solely to transverse force Fm-Fi by which it is moved perpendicularly to its axis, so that a generating line of cylindrical surface 11 of wall 10 of plunger 7 rests on a generating line of cylindrical surface 6 of wall 5. Consequently, clearance g between surfaces 11 and 6 is eliminated at the point of contact between surfaces 11 and 6, thus providing for effective guiding action. As, during the relative movement of the above generating lines, these are maintained substantially contacting, plunger 7 is moved strictly in the direction of the valve axis.

This favourable result is nevertheless also achieved even in the event the distance between planes $S_m$ and $S_G$ falls within the aforementioned range of values, in which case, forces Fi and Fm (no longer coplanar) result in a small amount of torque which tends to rotate plunger 7 about an axis perpendicular to that of the valve, but which is so small as to nevertheless enable contact to be maintained between the generating lines of cylindrical guide surface 6 and cylindrical surface 11 of wall 10 of plunger 7.

As such, plunger 7 moves in a straight line strictly parallel to the valve axis, so that the bottom surface of plunger 7 rests correctly on surface 16 in which injection orifice 9 is formed, thus preventing fuel leakage and so considerably improving the efficiency of the valve.

Moreover, by virtue of maintaining contact between straight generating lines, the valve according to the present invention provides for very little wear, and for eliminating localized wear of contact surfaces 6 and 11 typical of known valves and due to the plunger rotating about an axis perpendicular to that of the valve.

As such, the valve according to the present invention does not require precision machining, by virtue of the same favourable result also being achieved even in the event of considerable clearance g between surfaces 6 and 11.

Finally, unlike known valves, the valve according to the present invention need not necessarily be made of hard, high-cost materials, and provides for dispensing with post-machining processes for depositing layers of more wear-resistant material.

To those skilled in the art it will be clear that changes may be made to the embodiment described and illustrated herein without, however, departing from the scope of the present invention.

We claim:

1. An electromagnetic fuel metering and atomizing valve for a fuel supply device, comprising a valve body including a portion closed by an element which defines a fuel injection orifice, an electromagnet housed in said body, a plunger movable inside a guiding seat provided in said portion, said plunger including a lateral wall forming an armature for said electromagnet, and a bottom wall designed to rest on said element, said electromagnet being energizable for moving said plunger from a closed position wherein said bottom wall closes said injection orifice to an open position wherein said bottom wall allows said fuel to flow through said injection orifice, a coil spring partially housed inside said lateral wall and engaging said bottom wall to maintain said plunger in said closed position, said seat including a cylindrical guide surface having a predetermined longitudinal axis, said lateral wall being defined by a cylindrical lateral surface mating in sliding manner with said cylindrical guide surface, and wherein said plunger has a barycenter which lies in a plane perpendicular to said axis, and the distance between said plane and a mid plane of said cylindrical guide surface of said seat is less than 2 mm.

2. A valve as claimed in claim 1, characterized by the fact that said plane of the valve perpendicular to said axis coincides with the mid plane of said cylindrical guide surface of said seat.

* * * * *